United States Patent [19]

Hilfiker

[11] 4,051,570

[45] Oct. 4, 1977

[54] ROAD BRIDGE CONSTRUCTION WITH PRECAST CONCRETE MODULES

[75] Inventor: William K. Hilfiker, Eureka, Calif.

[73] Assignee: Hilfiker Pipe Co., Eureka, Calif.

[21] Appl. No.: 754,496

[22] Filed: Dec. 27, 1976

[51] Int. Cl.[2] ..... E01D 19/02

[52] U.S. Cl. ..... 14/26; 61/47; 14/75

[58] Field of Search ..... 14/75, 26, 1; 61/39, 61/47, 49; 52/227, 228, 169.1

[56] References Cited

U.S. PATENT DOCUMENTS

| | | | |
|---|---|---|---|
| 534,032 | 2/1895 | Clymer | 14/75 X |
| 932,261 | 8/1909 | Flynn | 61/39 |
| 2,315,441 | 3/1943 | McDaniel | 61/47 |
| 2,828,613 | 4/1958 | Wilson | 61/47 |
| 3,464,211 | 9/1969 | Anderson | 61/47 X |
| 3,631,682 | 1/1972 | Hilfiker | 61/47 |
| 3,922,864 | 12/1975 | Hilfiker | 61/47 X |
| 3,981,038 | 9/1976 | Vidal | 14/26 |

*Primary Examiner*—Nile C. Byers
*Attorney, Agent, or Firm*—Naylor, Neal & Uilkema

[57] ABSTRACT

Precast concrete footings, stretchers, road slabs, and curbing in conveniently transportable sizes are used to construct road bridges and supporting abutments with a minimum of heavy equipment at the construction site. Each stretcher module comprises an elongated concrete body having at least two support heads with flat upper and lower surfaces for stacking one on another. All support heads are equally spaced and each contains a vertical hole for receiving a steel tie rod that extends from the footing to the top surface of the abutment for tying together the stacked stretchers. Anchor rods to deadmen and lateral tie rods interconnecting the wing walls of the abutment are connected to the vertical tie rods to form a rigid interlocked retaining structure for supporting the prestressed concrete road slabs.

11 Claims, 9 Drawing Figures

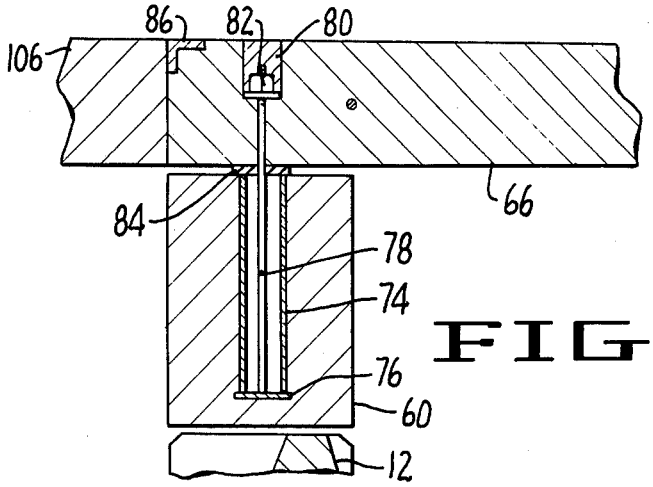
FIG. 6.
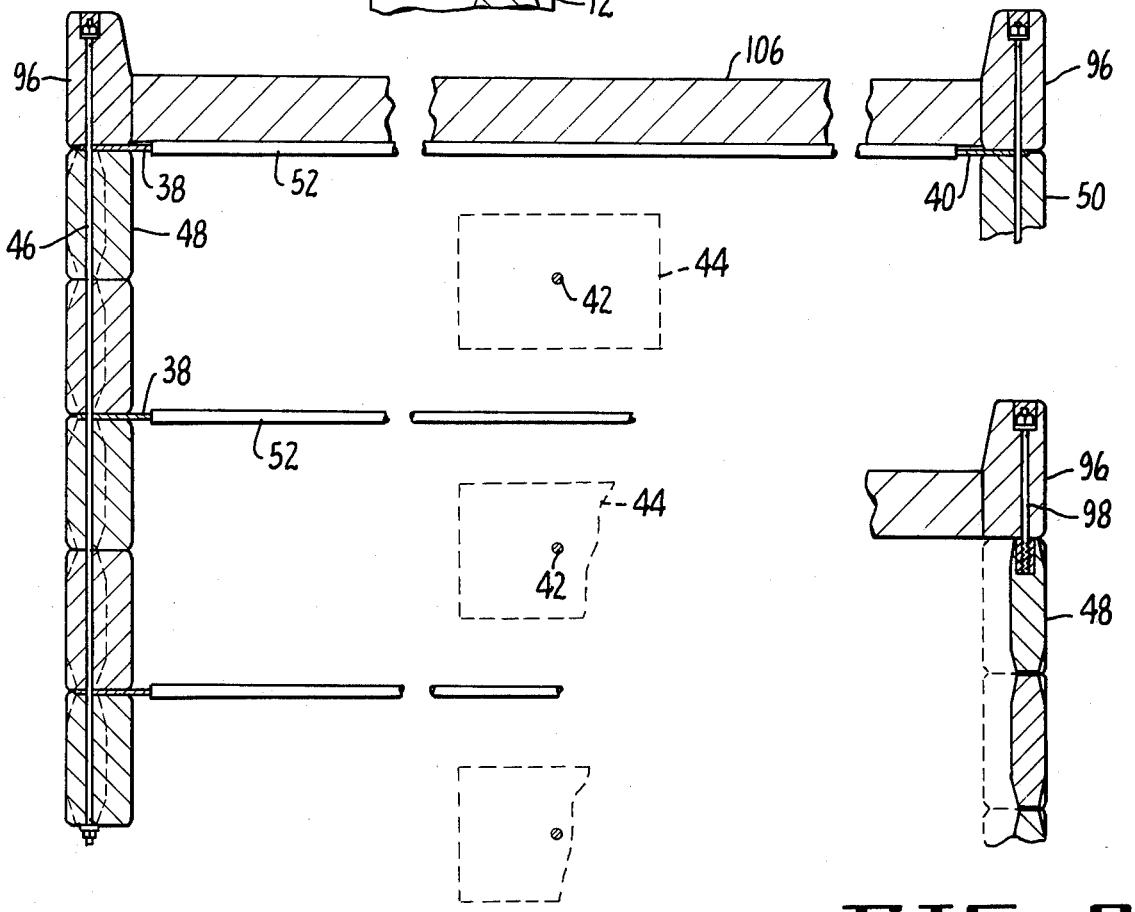
FIG. 7.
FIG. 8.
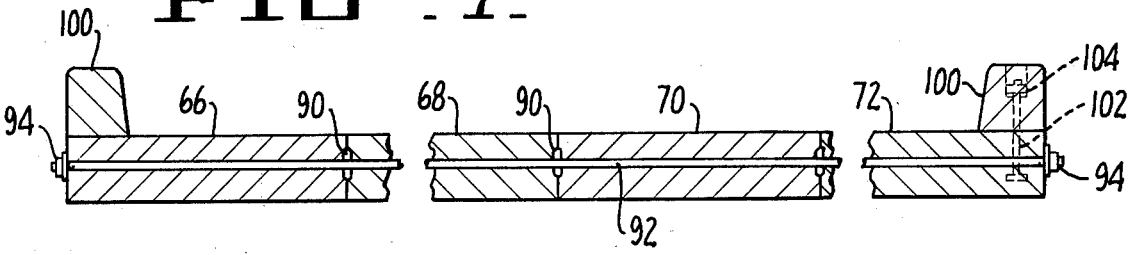
FIG. 9.

ROAD BRIDGE CONSTRUCTION WITH PRECAST CONCRETE MODULES

CROSS-REFERENCE TO RELATED APPLICATIONS

The present invention is closely related to copending patent application Ser. No. 711,081, filed Aug. 2, 1976 by the same applicant. This previously filed copending application describes the construction of retaining wall structures using portable precast stretchers in four basic configurations which are interlocked by vertical stretcher rods and horizontal anchor rods to form a rigid retaining wall.

SUMMARY OF THE INVENTION

This invention relates to the construction of road bridges and particularly to bridges constructed of precast concrete modules of the size that are readily transported to a remote construction site and assembled into strong rigid interlocking bridge abutments for supporting precast and prestressed roadway slabs.

The precast concrete modules of the invention are particularly suitable for assembling relatively small road bridges with a minimum of equipment. The modules may be precast at one central location and transported by truck to the purchaser or road contractor where they may be easily and rapidly assembled by two or three laborers with a single truck crane.

The heaviest module of the abutment is the footing which, for a 16 foot roadway, may be 5 feet wide and 16 feet long, and weigh 10 or more tons. Embedded into the top surface of the footing are threaded sockets into which are screwed vertical tie rods of a length determined by the total height of the abutment. Stacked on top of the footing is a retaining wall of precast concrete stretchers, each comprising a plurality of heads interconnected by concrete retaining bodies or webs. The heads have flat top and bottom surfaces and are cast with a vertical hole centrally located in the top and bottom surfaces to receive the vertical tie rods in the footing. At the end of each abutment stretcher is a half-head adapted to stack together with a mating half-head on a wing wall stretcher. At each end of the abutment is a wall of wing wall stretchers for retaining the fill material that supports the roadway approach to the bridge. Thus, the corner formed by the stacked half-heads and the full heads in the abutment stretcher form piers which support a heavy abutment beam that also contains vertical holes that receive the vertical tie rods extending upward from the footing.

The top surfaces of the full heads in each stretcher are grooved with a half inch depression about 6 inches wide and extending over the vertical tie rod hole. A half inch steel plate is fitted into each of these depressions and is provided with a drilled hole to receive the vertical tie rod. The steel plates between the abutment stretchers are welded to one end of an anchor rod, the opposite end of which is connected to a suitable deadman embedded in the embankment to prevent outward movement of the abutment. The steel plates between stretcher heads in the wing walls are connected by lateral tie rods to the plates in the opposite wing wall to prevent any possible expansion of the walls due to heavy road loading.

The heavy abutment beam supported on the abutment stretcher head piers supports one end of the bridge roadway which is comprised of several precast and prestressed concrete slabs of a size suitable for transporting to the bridge site. The several slabs contain appropriately spaced lateral holes that receive long threaded steel rods which, when stressed, tie the several slabs into a rigid bridge span.

DESCRIPTION OF THE DRAWINGS

In the drawings which illustrate a preferred embodiment of the invention:

FIG. 6 is a sectional elevation view taken along the lines 6—6 of FIG. 3 and illustrates the preferred method for connecting the bridge slabs to the abutment beam;

FIG. 7 is a sectional elevation view taken along the lines 7—7 of FIG. 3 and illustrates the vertical wing wall tie rods and the connection with the lateral tie rods;

FIG. 8 is a sectional elevation view taken along the lines 8—8 of FIG. 3 and illustrates a preferred method of connecting the road curbing to the top of a wing wall; and FIG. 9 is a sectional elevation view taken along the lines 9—9 of FIG. 2 and illustrates the interconnection of the several prestressed slabs making up the bridge roadway span.

DETAILED DESCRIPTION OF THE PREFERRED EMBODIMENT

Figure 1:
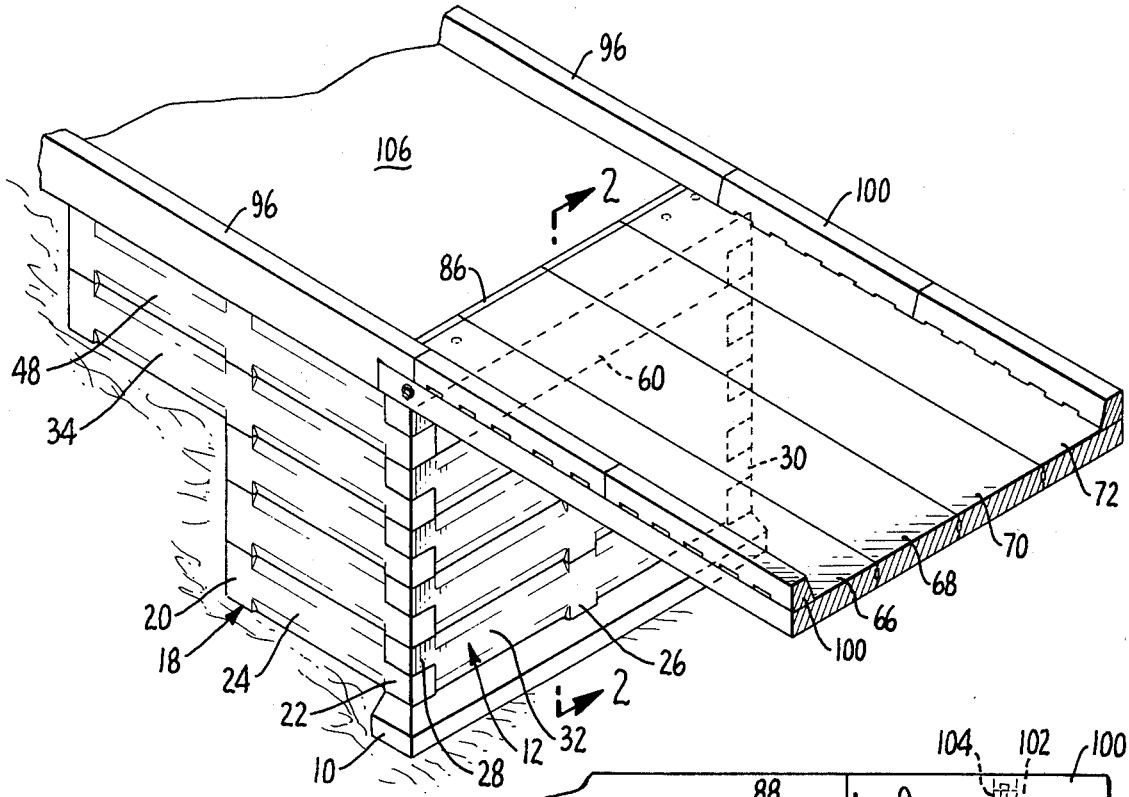
FIG. 1 is a perspective view illustrating the construction of the abutment and placement of the bridge span.

In the embodiment to be described, it will be assumed that it is desired to construct a short but strong bridge in a single lane, fourteen feet wide, roadway over a creek bed approximately twelve feet below grade level. The road bridge is supported on each side of the creek by an abutment, such as is shown in FIG. 1. As previously mentioned, every component going into the construction of the bridge and the abutment is precast reinforced concrete and of a size suitable for transportation to the bridge site by truck. It is apparent, therefore, that the individual modules may be precast at a manufacturing location that specializes in the economical fabrication of the modules from readily obtainable sources. Further, the use of precast modules obviates the older construction method of assembling concrete forms and mixing and pouring the concrete at the bridge site, which may, for example, be many miles over tortuous mountain roads from the nearest supply source. The use of the modules of this invention therefore reduces the labor and equipment costs and result in strong efficient bridges that are easily and rapidly assembled.

Figure 2:
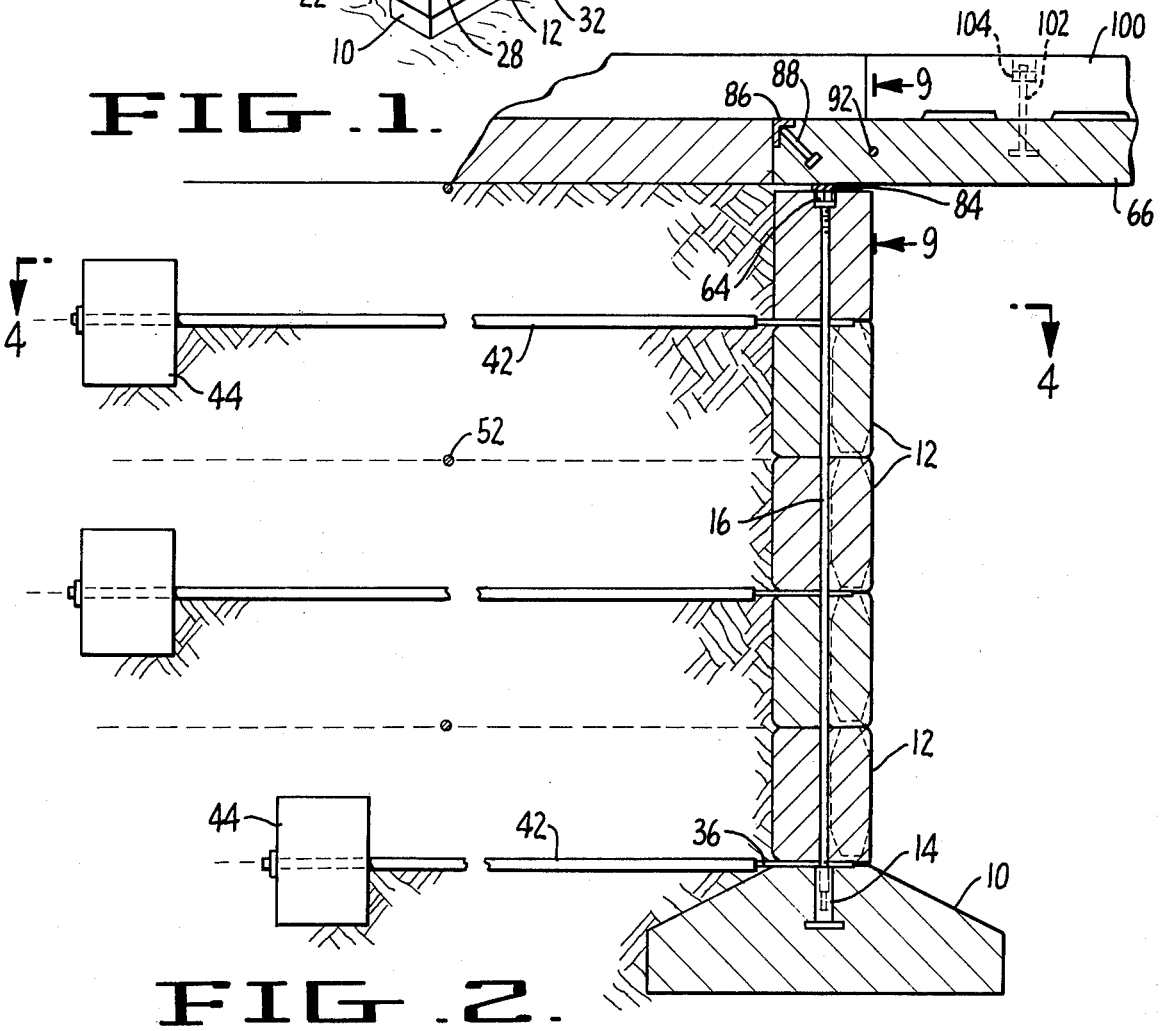
FIG. 2 is a side elevation view of the bridge abutment taken along the lines 2—2 of FIG. 1.

As illustrated in FIGS. 1 and 2, the foundation for the abutment is a footing 10 which, depending upon the subsoil conditions, is typically approximately 5 feet in width, 2 feet in height and 18 feet in length. The footing 10 may have peaked top surface but must have a level portion of its top surface approximately 1 foot in width upon which is stacked a plurality of abutment stretchers 12. Cast into the horizontal top surface of the footing 10 are threaded sockets 14, as best illustrated in FIG. 2. In the embodiment described, the footing 10 contains three sockets 14 placed 7 feet, 8 inches apart, with the middle socket placed precisely in the center of the top surface of the footing 10. The sockets 14 are threaded to receive the threaded ends of 1 inch diameter vertical tie rods 16 which, in the embodiment being described, are ten feet in length.

As illustrated in FIG. 1, the first module to be stacked upon the footing 10 is a wing wall half stretcher 18. The half stretcher 18 has a total overall length of 8 feet 9 inches and has, at one end, a full head 20 that is 2 feet in height, 1½ feet in width and 1 foot deep. The head 20 is cast with a 1½ inch diameter vertical center hole to receive a 1 inch diameter vertical tie rod, as will be subsequently explained. At the opposite end of the half stretcher 18 is a lower half-head 22 which is typically 18 inches wide, 18 inches deep, and 12 inches in height and is cast with a 1½ inch diameter vertical hole to receive the vertical tie rod 16. Intermediate of the full head 20 and the half-head 22 of the stretcher 18 is a web or retaining portion 24 which is 8 inches thick and approximately 23½ inches in height to provide a half inch bleed slot at the bottom for drainage. After the half-head 22 of the half stretcher 18 has been placed on the top surface of the footing 10, a mirror image half-stretcher is similarly placed at the opposite end of the footing 10, to be followed by the placement of the first abutment stretcher 12.

Figure 3:
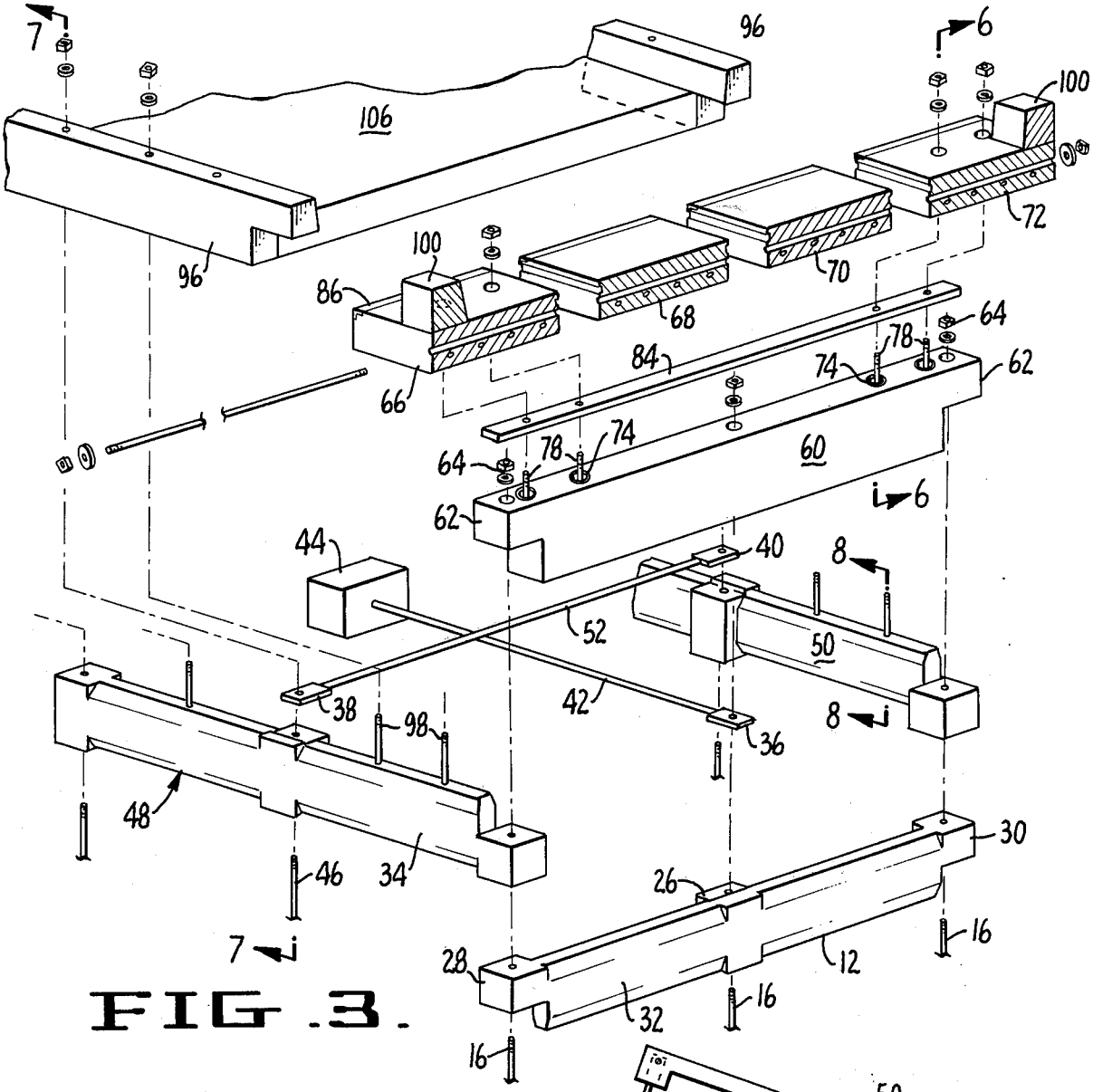
FIG. 3 is a perspective illustrated component breakdown showing the assembly of the various modules making up the bridge abutment.

As best illustrated in FIG. 3, abutment stretcher 12 is 16 feet in length and includes a centrally located full head 26 and upper half-heads 28, 30 at each end. The full head 26 is one and ½ feet deep by one and ½ feet wide by 2 feet high and is cast with a 1½ inch centrally located hole to receive the center vertical tie rod 16. The half-heads 28 and 30 are 1½ feet in width and depth by 1 foot in height, and each contain a 1½ inch diameter hole located along the longitudinal center line of the stretcher and spaced from the center hole by the 7 foot eight inch spacing of the vertical tie rods 16. As previously explained in connection with the wing wall stretcher 18, the heads 26, 28 and 30 are interconnected by a retaining section 32, which is similarly 8 inches thick by 23½ inches in height.

The abutment is constructed by placing alternate sections of wing wall stretchers and abutment stretchers over their respective vertical tie rods. If the enbankment is such that a longer wing wall stretcher is required, a wing wall full stretcher 34 may be employed, stretcher 34 is typically 16 feet in length with heads and head spacing similar to the half stretcher 18.

As best illustrated in FIG. 3, the top surface of each full head in either the abutment stretchers 12 or wing wall stretchers 18 and 34, contain a recessed section approximately 6 inches wide and a ½ inch depth to accommodate half-inch thick steel plates 36, 38 and 40. The steel plates, such as steel plate 36, are drilled to receive the vertical tie rod 16 and, as the construction of the abutment and wing walls proceed, the steel plates are threaded over the tie rod 16. Welded to the steel plates, such as steel plate 36 of FIG. 2, is one end of an anchor rod 42, the opposite end of which is firmly connected to a suitable deadman 44 that will be buried in the enbankment. As shown in FIG. 3, the plate 38 is threaded over the vertical tie rod 46 that extends through the full head of the wing wall stretcher 48, and the plate 40 is similarly connected to the mirror image stretcher 50 in the opposite wing wall. Plates 38 and 40 are then interconnected by a lateral tie rod 52 to prevent possible expansion of the wing walls of the abutment that may be caused by ground slippage or high road loads.

Figure 4:
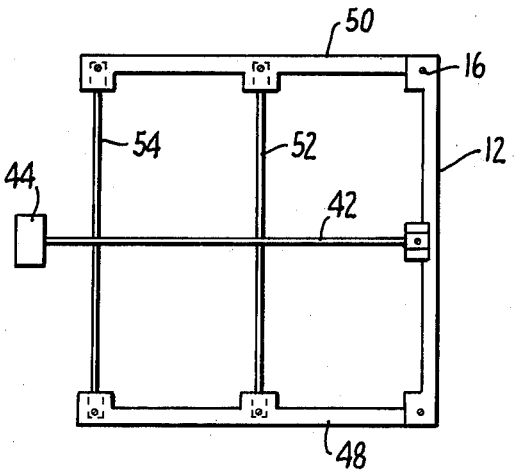
FIG. 4 is a plan view of the abutment taken along the lines 4—4 of FIG. 2.
Figure 5:
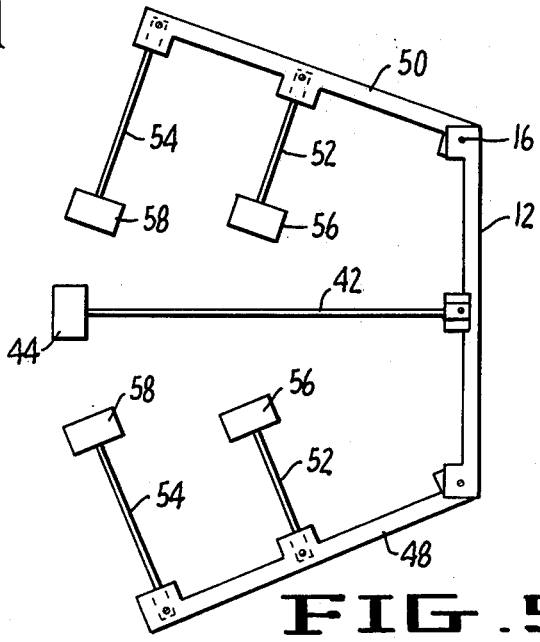
FIG. 5 is a plan view of an alternate design of the abutment and illustrates typical placement of anchor rods and deadmen for anchoring flared wing walls.

As illustrated in the plan view of FIG. 4, the tie rods 52 and 54 interconnect the wing wall stretchers 48 and 50, while the anchor rod 42 interconnects the abutment stretcher 12 with an embedded deadman 44 to prevent movement of the abutment. If conditions require, the alternate design illustrated in FIG. 5 may be used to form flared wing walls for the abutment 12. In such a case, the tie rods 52 and 54 may not interconnect the wing walls 48 and 50 but may be connected directly to deadmen 56 and 58, respectively, that are suitably embedded in the embankment to prevent slippage of the wing walls.

After the wing wall stretchers and the abutment stretchers have been stacked along the anchor rod plates and horizontal tie rod plates and the top course of wing wall stretchers has been placed in position, the top module to be placed on the abutment stretchers 12 is an abutment beam 60. The abutment beam 60 is a massive precast concrete member 2 feet in height by 18 inches thick by 16 feet in length. As best illustrated in FIG. 3, the beam 60 contains an upper half-head 62 at each end to mate with the lower half-head in the wing wall stretcher 48. As with the abutment stretchers 12, the abutment beam 60 is provided with 1½ inch diameter holes to receive the vertical tie rods 16. However, each of the three holes for the tie rods 16 are enlarged to a diameter of 3 inches for depth of 2 inches into the top surface of the beam 60 to provide recessed holes into which suitable washers and nuts may be applied to the ends of the rods 16 which do not extend above the top surface of the beam 60. Thus, the tightening of the nuts 64 apply stress to the rod 16 which firmly secures all of the abutment stretchers to form a unified solid abutment. It will be noted that the massive abutment beam 16 is supported by the three piers that are made up by the stacked heads and half-heads of the abutment stretchers 12 and the wing wall stretchers.

In addition to the three vertical holes through the abutment beam 60 to receive the vertical tie rods 16, the abutment beam 60 has additional holes in its top surface for receiving the bolts that will secure the end of the road slabs 66, 68, 70 and 72, as shown in FIG. 3.

Four 3 inch diameter pipe sleeves, 1½ feet in length, are cast into the top surface of the abutment beam 60 along its longitudinal center line and at distances of 1 foot and 3 feet from the extreme ends of the abutment beam. As shown in the detailed sectional view of FIG. 6, the sleeves are cast within the abutment beam 60 so that one end of each sleeve, for example, sleeve 74, is flush with the top surface of the beam 63. Prior to the casting process, however, a cap 76 is welded to the lower opening of the sleeve and a threaded resilient rod 78 is welded to the center of the cap 76 so that the rod 78 extends approximately ten inches above the top surface of the beam 60. As shown in detail in FIG. 6, the concrete road slab 66 contains a counterbored hole 80 which receives the threaded rod 78 and its nut and washer 82, and the rod 78 anchored a foot and a half below the bottom surface of slab 66 provides an effective expansion connection that secures the slab 66 but permits lateral movement. If desired, prior to the installation of the road slab 66, the volume within the pipe sleeve 74 may be filled with an elastomeric grouting material. Prior to the placing of the road slabs, the top surface of abutment beam 60 is capped with a long elastomeric pad 84 which serves to provide a cushion between the road slabs 66, 68, 70 and 72 and the top surface of the abutment beam 60, as best illustrated in FIG. 3.

As previously indicated, the pipe sleeves 74, with their integral threaded rod 78, are placed near the ends of the abutment beam 60. They therefore only anchor the two outside road slabs 66 and 72. The road slabs in the preferred embodiment being described are 1 foot thick, 4 feet wide, and of an appropriate length to mate with the abutment beam on the opposite enbankment. As best shown in FIG. 2, the top ends of each of the road slabs, such as the slab 66, is protected by a 4 by 4 inch angle iron 86, to which has been welded a suitable anchor bolt 88 prior to the casting of the road slab 66. The angle iron 86 is merely provided to prevent chipping of the exposed corner of the slab 66.

Each of the road slabs 66, 68, 70 and 72 are suitably reinforced and prestressed by acceptable methods. The slabs are cast with long longitudinal slots 90 in their mating edges, as best illustrated in FIGS. 3 and 9, and are cast with lateral holes two inches in diameter through which 1¼ inch diameter threaded steel rods 92 are installed and tensioned with appropriate nuts 94 and underlying washers to clamp the four road slabs together into a solid unified bridge slab. Prior to the tightening of the nuts 94 that stress the rods 92, a grouting cement is applied into the longitudinal slots 90 in the mating edges of the road slabs 66, 68, 70 and 72. After the rods 92 are stressed and the grouting has cured, the slab is completed and ready to receive the curbing.

As illustrated in FIG. 1 and in detail in FIG. 3, the top course wing wall stretcher 48 is topped with a curbing 96, which is approximately one foot wide, two feet high and of any convenient length. As best illustrated in FIG. 3, the curbing 96 contains vertical holes for receiving bolts 98 that were embedded into the top surface of the wing wall stretcher 48 during the casting operation and also for receiving the vertical tie rods 46 that extend through the full heads of the wing wall stretchers, as shown in FIGS. 7 and 8.

A curbing 100 is also applied to the outside edges of road slabs 66 and 72 as shown in FIGS. 1 and 9. Because the road slabs have been clamped and grouted together to effectively form a single watertight slab, the curbing 100 is slotted on its lower surface to provide adequate drainage from the road slab. As illustrated in FIG. 9, the outer slabs 66 and 72 are cast with bolts 102 extending above the upper surface of the slab at predetermined intervals and the curbing 100 contains countersunk holes adapted to receive the bolts 102. After the curbing is installed and tightened by the nuts 104, a grounting cement is inserted to fill the counterbored holes to provide a smooth and watertight surface to the curbing 100.

The road bridge has now been completely assembled and the abutment enclosure is ready to receive a suitable fill material and road surfacing 106, as shown in FIGS. 1 and 7.

CONCLUSION

Although a preferred embodiment of the invention has been illustrated and described, it should be understood that the invention is not intended to be limited to the specifics of that embodiment, but rather is defined by the accompanying claims.

What is claimed is:

1. A road bridge including an abutment therefor formed of readily transportable precast construction modules, said bridge comprising: a footing placed below road grade; generally vertical extending tie rods connected to said footing and extending upwardly therefrom, at least one of said rods being positioned adjacent each end of said footing; at least one abutment stretcher positioned above and parallel to said footing, said stretcher having an elongated retaining body interconnecting support heads at either end of the stretcher, said heads having top and bottom stacking surfaces and each having a vertical hole therethrough, said holes being so spaced from one another that said holes will receive said vertical tie rods; an abutment beam overlying the topmost of said abutment stretchers, said beam having holes spaced to receive said vertical tie rods; means securing the beam to the tie rods to stress the rod and capture the stretchers beneath the beam between the beam and the footing; and, a bridge roadbed placed with one end overlying and supported by said abutment beam.

2. A bridge, according to claim 1, further including: anchor means coupled to said abutment, said anchor means comprising a steel plate having an opening therein received around one of the vertical tie rods; an anchor rod secured to and extending from the plate; and an embedded deadman secured to the end of the anchor rod opposite that secured to the plate.

3. A bridge, according to claim 1, further including wing wall stretchers extending rearwardly from the ends of said abutment stretchers, said wing wall stretchers having vertical holes therein received around the vertically extending tie rods; and transverse tie rods secured to and extending between said wing wall stretchers.

4. A bridge, according to claim 3, wherein: the wing wall stretchers of each wing wall are interconnected by tie rods extending vertically therethrough and the transverse tie rods comprise steel plates interconnected by a horizontal tie rod, each of said plates having a hole therein received around a vertical tie rod extending through the wing wall stretchers.

5. A bridge, according to claim 1, wherein said roadbed is comprised of one or more elongated concrete slabs and at least one of said elongated roadbed slabs is attached to said abutment beam by a resilient expansion connection comprising: an elongated hollow tubing cast within said beam normal to the top surface thereof and extending from said top surface to the interior of said beam; a cap secured to the end of the tubing within said beam; and a bolt secured to the top and extending coaxially through said tubing and through a corresponding anchoring hole in said roadbed slab.

6. A bridge, according to claim 5, wherein said bridge roadbed is separated from the top of said abutment beam by a resilient cushioning strip.

7. A bridge, according to claim 1, wherein the roadbed is comprised of a plurality of elongated concrete slabs and said slabs have mating edges with confronting grooves therein filled with grout.

8. A bridge, according to claim 1, wherein said roadbed is comprised of a plurality of elongated concrete slabs and said slabs are connected together by horizontal tie rods extending transversely therethrough.

9. A bridge, according to claim 1, further including a bridge abutment wing wall, said wall comprising at least one substantially horizontal wing wall stretcher having an elongated retaining body with a support head at one end thereof, said head having a vertical hole therethrough received around the vertical tie rod extending from one end of the footing.

10. A bridge, according to claim 9, wherein the stacking heads at the end of said abutment stretcher and at the end of said wing wall stretcher are substantially half the height of the retaining bodies of said stretchers, said half height heads being mated together in alternate courses to form an interlocking corner between said abutment and said wing wall.

11. A bridge, according to claim 10, further including a road curbing overlying the top course of said wing wall stretchers, said curbing being connected to said top course by threaded tie rods embedded in said top course and extending through vertical holes in said curbing.

* * * * *